US005740738A

United States Patent [19]

Niemiro

[11] Patent Number: 5,740,738

[45] Date of Patent: Apr. 21, 1998

[54] GAPLESS BLANKET CYLINDER

[75] Inventor: Thaddeus A. Niemiro, Lisle, Ill.

[73] Assignee: Goss Graphic Systems, Inc., Westmont, Ill.

[21] Appl. No.: 702,395

[22] Filed: Aug. 14, 1996

[51] Int. Cl.[6] ..... B41F 13/193; B41F 27/00

[52] U.S. Cl. ..... 101/376; 101/389.1; 492/8

[58] Field of Search ..... 101/217, 375, 101/376, 382.1, 383, 384, 389.1; 492/4, 8, 18, 48, 49, 56

[56] References Cited

U.S. PATENT DOCUMENTS

| | | | |
|---|---|---|---|
| 3,745,626 | 7/1973 | Bray | 101/389.1 |
| 4,676,161 | 6/1987 | Peekna | 101/389.1 |
| 4,817,527 | 4/1989 | Wouch et al. | 101/389.1 |
| 4,913,048 | 4/1990 | Tittgemeyer | 101/141 |
| 5,038,680 | 8/1991 | Bain | 101/217 |
| 5,209,163 | 5/1993 | Banike | 101/389.1 |
| 5,351,615 | 10/1994 | Köbler et al. | 101/376 |
| 5,410,965 | 5/1995 | DeVries | 101/383 |

FOREIGN PATENT DOCUMENTS

| | | | |
|---|---|---|---|
| 2335682 | 1/1974 | Germany | 101/389.1 |
| 8264 | 1/1981 | Japan | 101/375 |

*Primary Examiner*—Stephen R. Funk
*Attorney, Agent, or Firm*—Marshall, O'Toole, Gerstein, Murray & Borun

[57] ABSTRACT

A blanket cylinder (10) having an inner mandrel (12) having an outer surface (14), a split shell (16) having a longitudinal slit (18) defining opposed ends (20 and 22) of the shell (16), and being positioned on the outer surface of the mandrel (12) with a minimal gap (24) between the opposed ends (20 and 22) of the shell (16), a device for retaining the shell (16) on the mandrel (12), and a compressible blanket (34) being formed on an outer surface (36) of the shell (36) and having dimensions to close the opposed ends (20 and 22) of the shell (16).

10 Claims, 1 Drawing Sheet

GAPLESS BLANKET CYLINDER

BACKGROUND OF THE INVENTION

The present invention relates to blanket cylinders for a printing press.

As the requirement for faster speeds of a printing press increases, the conventional blanket cylinder construction with a lock-up gutter becomes increasingly inadequate. Thus, there is a need for gapless blankets to increase the press speed while maintaining print quality, thus increasing productivity, save paper by decreasing the cut-off gap, and decrease press down time by decreasing blanket change time.

SUMMARY OF THE INVENTION

A principal feature of the present invention is the provision of an improved blanket cylinder for a printing press.

The blanket cylinder of the present invention comprises, an inner mandrel having an outer surface, a split shell having a longitudinal slit defining opposed ends of the shell, and being positioned on the outer surface of the mandrel with a minimal gap between the opposed ends of the shell, means for retaining the shell on the mandrel, and a compressible blanket being formed on an outer surface of the shell.

A feature of the present invention is that the blanket has dimensions to close the opposed ends of the shell.

Another feature of the invention is that the shell and blanket results in the formation of a gapless blanket cylinder.

Yet another feature of the invention is that the blanket of the present invention increases the press speed while maintaining print quality.

Thus, a feature of the present invention is that the blanket of the invention increases productivity of the press.

Still another feature of the invention is that the blanket of the invention saves paper by decreasing the cut-off gap.

Another feature of the invention is that the blanket of the invention decreases press down time by decreasing blanket change time.

Further features will become more fully apparent in the following description of the invention, and from the appended claims.

DESCRIPTION OF THE PREFERRED EMBODIMENTS

Figure 1:
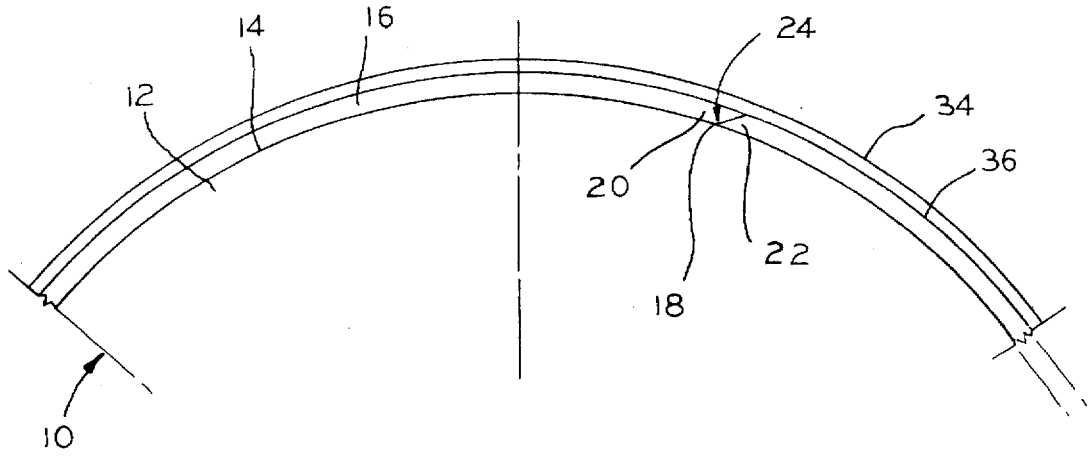
FIG. 1 is a fragmentary sectional view of a blanket cylinder of the present invention.
Figure 2:
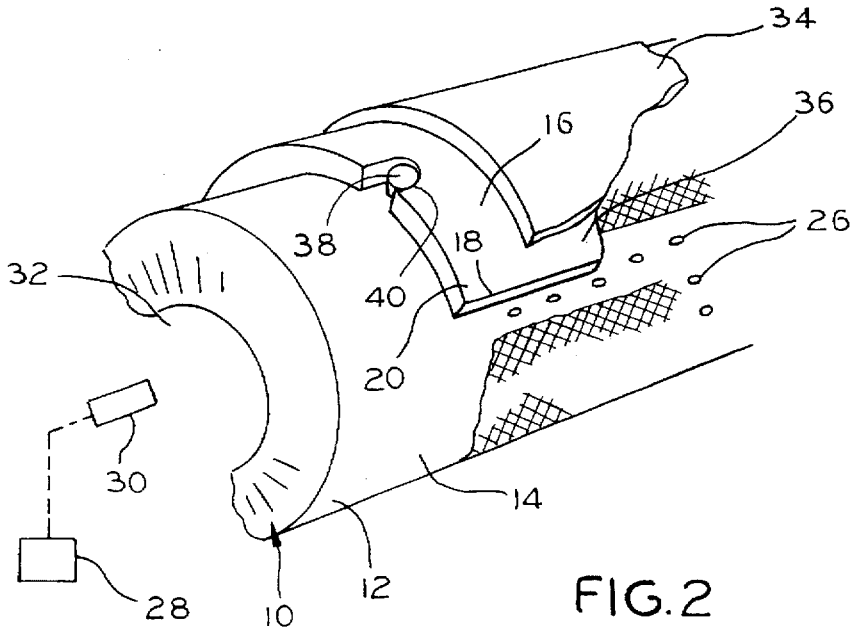
FIG. 2 is a fragmentary perspective view, partly broken away, of the blanket cylinder of FIG. 1.

Referring now to FIGS. 1 and 2, there is shown a blanket cylinder generally designated 10 for a printing press. The blanket cylinder 10 has an inner precision mandrel 12 which may be constructed of any suitable material, such as steel. The mandrel 12 has an outer surface 14.

The cylinder 10 has a split shell or sleeve 16 having a longitudinal slit 18 defining opposed ends 20 and 22 of the shell 16. The shell 16 is positioned on the outer surface 14 of the mandrel 12 with a minimal gap 24 between the opposed ends 20 and 22 of the shell 16.

In one embodiment, the blanket cylinder 10 has a plurality of apertures or openings 26 in the outer surface 14 of the mandrel 12. The apertures 26 communicate with a source of vacuum 28 through a conduit 30 which extends through a journal 32 of the mandrel 12. Thus, the vacuum source 28 is applied through the openings 26 to the shell 16 in order to hold the shell 16 in place. In this embodiment, the shell 16 may be constructed from any suitable composite material, such as fiberglass, or it may be constructed from any suitable metal.

In another embodiment, the mandrel 12 has an outer portion near the surface 14 which is magnetized, and the shell 16 is made from a magnetically permeable material, such as steel. Thus, the magnetic mandrel 12 holds the magnetically permeable material of the shell 16 in place.

The blanket 10 has an outer compressible blanket 34, such as an elastomeric material, which is formed on an outer surface 36 of the shell 16. The inner diameter of the blanket 34 is slightly less than the outer diameter of the outer surface 36 of the shell 16. A slight air pressure is used to slide the blanket 34 over the shell 16 through an open operating side frame of the press. The blanket 34 thus has dimensions to close the opposed ends 20 and 22 of the shell 16 to a minimal gap 24, such as 0.002–0.003inches. Thus, a gapless cylinder is formed by the shell 16 and blanket 34.

The mandrel 12 may have an outer retractable pin 38 which is received in an opening 40 of the shell 16 in order to locate the shell 16 on the mandrel 12.

In a preferred form, the shell 16 has a thickness of approximately 1–2 mm. The inside diameter of the shell 16 is about 0.002 inches smaller than the final printing cylinder on which it is to be mounted. The thickness of the blanket 34 is approximately 0.050–0.100 inches. The blanket 34 closes the gap 24 of the shell 16 to a minimal amount, such as approximately 0.002 to 0.003 inches.

Thus, a gapless blanket cylinder 10 is formed by the shell 16 and blanket 34. The blanket cylinder 10 thus formed increases the press speed while maintaining print quality, thus increasing productivity of the press. The blanket cylinder 10 also saves paper of the web in the press by decreasing the cut-off gap, and decreases press down time by decreasing blanket change time.

The foregoing detailed description has been given for clearness of understanding only, and no unnecessary limitations should be understood therefrom, as modifications will be obvious to those skilled in the art.

What is claimed is:

1. A blanket cylinder formed by a process comprising the steps of:

providing an inner mandrel having an outer surface;

providing a split shell having a longitudinal slit defining opposed ends of the shell;

positioning the split shell on the outer surface of the mandrel with a gap between the opposed ends of the shell;

retaining the split shell on the mandrel; and providing a compressible blanket having an inner diameter slightly less than a diameter of an outer surface of the split shell mounting the compressible blanket on the outer surface of the split shell thereby forcing the closure of the gap between the opposed ends of the shell.

2. The cylinder of claim 1 wherein the split shell is retained by a vacuum in the mandrel communicating with the outer surface of the mandrel.

3. The cylinder of claim 2 wherein the split shell is constructed from a composite material, or any metallic material.

4. The cylinder of claim 3 wherein the split shell is constructed from steel.

5. The cylinder of claim 1 wherein the split shell is constructed of a magnetically permeable material and is retained by a magnetic outer portion of the mandrel.

6. The cylinder of claim 1 wherein the split shell is provided with an opening which registers with a retractable pin located on the outer surface of the mandrel.

7. A gapless blanket cylinder, comprising:

an inner mandrel having an outer surface;

a split shell having a longitudinal slit defining opposed ends of the shell, the opposed ends of the split shell being disposed on the outer surface of the mandrel, the split shell being dimensioned such that the opposed ends define a gap absent an external force;

means associated with the mandrel for retaining the split shell on the mandrel; and a compressible blanket formed on an outer surface of the split shell, said compressible blanket having an inner diameter slightly less than a diameter of the outer surface of the split shell so as to provide an external force to the split shell, the compressible blanket maintaining the closure of the gap between the opposed ends of the shell;

whereby a gapless blanket cylinder is provided.

8. The cylinder of claim 7 wherein the retaining means associated with the mandrel comprises a vacuum in the mandrel in communication with the outer surface of the mandrel.

9. The cylinder of claim 7 wherein the retaining means comprises a magnetic outer portion of the mandrel, and the split shell is constructed of a magnetically permeable material.

10. The cylinder of claim 7 including a retractable pin located on the outer surface of the mandrel, and wherein the split shell has an opening which registers with the retractable pin.

* * * * *

UNITED STATES PATENT AND TRADEMARK OFFICE

CERTIFICATE OF CORRECTION

PATENT NO. : 5,740,738
DATED : April 21, 1998
INVENTOR(S) : Niemiro

It is certified that error appears in the above-identified patent and that said Letters Patent is hereby corrected as shown below:

Column 2,
Line 22, please delete "0.002-0.003inches" and insert in its place -- 0.002-0.003 inches --.

Signed and Sealed this

Sixth Day of November, 2001

*Attest:*

Nicholas P. Godici

NICHOLAS P. GODICI
*Acting Director of the United States Patent and Trademark Office*

*Attesting Officer*